US008152881B2

(12) United States Patent
Chen et al.

(10) Patent No.: US 8,152,881 B2
(45) Date of Patent: Apr. 10, 2012

(54) HOUSING FOR A CENTRIFUGAL FAN, THE CENTRIFUGAL FAN, AND ELECTRONIC DEVICE HAVING THE CENTRIFUGAL FAN

(75) Inventors: Ming-Chih Chen, Taipei Hsien (TW); Wei-Cheng Chou, Taipei Hsien (TW)

(73) Assignee: Wistron Corporation, Taipei Hsien (TW)

( * ) Notice: Subject to any disclaimer, the term of this patent is extended or adjusted under 35 U.S.C. 154(b) by 381 days.

(21) Appl. No.: 12/582,193

(22) Filed: Oct. 20, 2009

(65) Prior Publication Data

US 2010/0275560 A1 Nov. 4, 2010

(30) Foreign Application Priority Data

May 4, 2009 (TW) ..... 98207529 U

(51) Int. Cl.
*B01D 45/04* (2006.01)

(52) U.S. Cl. ..... 55/385.6; 55/385.7; 55/471; 55/472; 55/473

(58) Field of Classification Search ..... 55/385.6, 55/385.7, 438, 400, 471, 473; 454/184, 192; 123/41.65; 415/121.2; 416/182, 206, 223 B, 416/224

See application file for complete search history.

(56) References Cited

U.S. PATENT DOCUMENTS

| | | | | |
|---|---|---|---|---|
| 5,044,887 | A * | 9/1991 | Duthie et al. | 416/223 B |
| 5,367,988 | A * | 11/1994 | Collins | 123/41.65 |
| 6,514,304 | B2 * | 2/2003 | Fiacco | 55/400 |
| 6,607,574 | B2 * | 8/2003 | Maier et al. | 55/385.7 |
| 2007/0231130 | A1 * | 10/2007 | Hanazuka et al. | 415/206 |
| 2010/0238619 | A1 * | 9/2010 | Shirasaka | 361/679.08 |

* cited by examiner

*Primary Examiner* — Duane Smith
*Assistant Examiner* — Minh-Chau Pham
(74) *Attorney, Agent, or Firm* — Stephen A. Bent; Foley & Lardner LLP

(57) ABSTRACT

A housing for a centrifugal fan includes a surrounding wall extending upwardly from a periphery of a bottom wall with an air inlet, and including a surrounding wall body defining an opening, a protruding wall body extending outwardly from the surrounding wall body, corresponding to the opening, and having a dust-discharging hole, and a shielding plate disposed on the protruding wall body. The surrounding wall body and the bottom wall cooperatively define an accommodation space communicated with the air inlet, and an air outlet communicated with the accommodation space. The protruding wall body, the shielding plate, and the bottom wall cooperatively define a turbulence space communicated with the accommodation space. The shielding plate is movable between a closed position to close the dust-discharging hole, and an open position to open the dust-discharging hole so as to permit fluid communication between the turbulence space and the outside environment.

20 Claims, 10 Drawing Sheets

HOUSING FOR A CENTRIFUGAL FAN, THE CENTRIFUGAL FAN, AND ELECTRONIC DEVICE HAVING THE CENTRIFUGAL FAN

CROSS-REFERENCE TO RELATED APPLICATION

This application claims priority of Taiwanese Application No. 098207529, filed on May 4, 2009.

BACKGROUND OF THE INVENTION

1. Field of the Invention

The invention relates to a housing for a centrifugal fan, the centrifugal fan, and an electronic device having the centrifugal fan, more particularly to a housing for a centrifugal fan having dust collecting and discharging functionality, the centrifugal fan, and an electronic device having the centrifugal fan.

2. Description of the Related Art

Referring to FIG. 1, in a conventional heat-dissipating module of a notebook computer, a thin type centrifugal fan 1 is generally adopted as a heat-dissipating fan. The centrifugal fan 1 includes a housing 11, and an impeller 12 disposed in the housing 11. The housing 11 defines an accommodation space 111 for accommodating the impeller 12, a plurality of air inlets 112 in fluid communication with the accommodation space 111, and an air outlet 113 in fluid communication with the accommodation space 111. By rotating the impeller 12, air can be drawn into the accommodation space 111 through the air inlets 112 and discharged through the air outlet 113 so as to dissipate the heat around a heat-dissipating fin unit 2 disposed at the air outlet 113.

Since air is laden with dust particles 10 such as fine particles, hair, lint, etc., and since the air outlet 113 of the centrifugal fan 1 is blocked by densely arranged fins 21 of the heat-dissipating fin unit 2, the dust particles 10 are likely to accumulate on a tongue portion 114 of the housing 11, between a hub 121 and vanes 122 of the impeller 12, on sides of the fins 21 of the heat-dissipating fin unit 2 that confront the air outlet 113, and in clearances (not shown) among the fins 21, which may adversely affect the heat-dissipating efficiency of the centrifugal fan 1.

A current dust proofing technology is to isolate the dust particles 10 from a rotary shaft (not shown) of the impeller 12. Although this approach may ensure normal operation of the impeller 12, problems associated with the accumulation of dust particles 10 remain unresolved. Another dust proofing method is to install a dust-proof filter screen on an outer surface of the housing 11 at a position corresponding to the air inlets 112 or on a casing of the notebook computer at a position corresponding to the air inlets 112 so as to prevent the dust particles 10 entrained in the air from entering the accommodation space 111. However, such a design will lead to a reduction in the amount of intake air, which may result in poor heat-dissipating efficiency. Therefore, how to devise a structure that can prevent accumulation of dust particles 10 in the accommodation space 111 of the centrifugal fan 1 without sacrificing the heat-dissipating efficiency of the centrifugal fan 1 is the subject of improvement of the present invention.

SUMMARY OF THE INVENTION

Therefore, the primary object of the present invention is to provide a housing for a centrifugal fan, which is designed to have a turbulence space where a vortex is generated when an air stream flows therethrough so that dust particles entrained in the air stream can accumulate in the turbulence space and can be discharged from the housing when a shielding plate is opened.

Another object of the present invention is to provide a centrifugal fan including a housing that is designed to have a turbulence space where a vortex is generated when an air stream flows therethrough so that dust particles entrained in the air stream can accumulate in the turbulence space and can be discharged from the housing when a shielding plate is opened.

Still another object of the present invention is to provide an electronic device having a centrifugal fan that includes a housing designed to have a turbulence space where a vortex is generated when an air stream flows therethrough so that dust particles entrained in the air stream can accumulate in the turbulence space and can be discharged from the housing when a shielding plate is opened.

The objects of this invention and solutions to the technical problems associated with the prior art are realized using the following technical means. The housing for a centrifugal fan according to the present invention comprises a bottom wall and a surrounding wall.

The bottom wall includes an air inlet. The surrounding wall extends upwardly from a periphery of the bottom wall, and includes a surrounding wall body defining an opening, a protruding wall body extending outwardly from the surrounding wall body and corresponding to the opening in position, and a shielding plate. The protruding wall body includes a dust-discharging hole. The shielding plate is disposed on the protruding wall body for shielding the dust-discharging hole. The surrounding wall body and the bottom wall cooperatively define an accommodation space that is in fluid communication with the air inlet, and an air outlet in fluid communication with the accommodation space. The protruding wall body, the shielding plate, and the bottom wall cooperatively define a turbulence space in fluid communication with the accommodation space. The shielding plate is movable between a closed position to close the dust-discharging hole, and an open position to open the dust-discharging hole so as to permit fluid communication between the turbulence space and the outside environment.

The objects of this invention and solutions to the technical problems associated with the prior art can be further realized using the following technical means.

In the aforementioned housing for a centrifugal fan of the present invention, the protruding wall body includes an air blocking wall portion extending outwardly from the surrounding wall body for blocking airflow, and a connecting wall portion extending outwardly from the surrounding wall body. The air blocking wall portion has an outer end connected to an outer end of the connecting wall portion such that the air blocking wall portion and the connecting wall portion form an angle therebetween. The angle is one of a right angle and an acute angle. Thus, a vortex can be generated in the turbulence space when air flows therethrough so that dust particles entrained in the air can accumulate in the turbulence space.

In the aforementioned housing for a centrifugal fan, the dust-discharging hole is provided in the air blocking wall portion. The shielding plate is connected pivotably to the air blocking wall portion and is pivotable between the closed and open positions. Thus, when the shielding plate is at the open position, dust particles collected in the turbulence space can be directly discharged from the turbulence space through the dust-discharging hole.

A centrifugal fan of the present invention comprises a housing and an impeller. The housing includes a bottom wall and a surrounding wall. The bottom wall includes an air inlet. The surrounding wall extends upwardly from a periphery of the bottom wall, and includes a surrounding wall body defining an opening, a protruding wall body extending outwardly from the surrounding wall body and corresponding to the opening in position, and a shielding plate. The protruding wall body includes a dust-discharging hole. The shielding plate is disposed on the protruding wall body for shielding the dust-discharging hole. The surrounding wall body and the bottom wall cooperatively define an accommodation space that is in fluid communication with the air inlet, and an air outlet in fluid communication with the accommodation space. The protruding wall body, the shielding plate, and the bottom wall cooperatively define a turbulence space in fluid communication with the accommodation space. The shielding plate is movable between a closed position to close the dust-discharging hole, and an open position to open the dust-discharging hole so as to permit fluid communication between the turbulence space and the outside environment. The impeller is disposed in the accommodation space, and is rotatable to result in generation of an air stream.

In the aforementioned centrifugal fan, the air blocking wall portion blocks a flow path of the air stream generated by the impeller. Thus, a vortex can be generated in the turbulence space when the airflows therethrough.

The aforementioned centrifugal fan further comprises an actuating unit that includes a magnet disposed on the connecting wall portion, and a metal piece disposed on the shielding plate. The metal piece can be attracted by the magnet so as to position the shielding plate at the closed position. Thus, the shielding plate and the air blocking wall portion can block the air stream cooperatively.

In the aforementioned centrifugal fan, the metal piece is rod-shaped. The actuating unit further includes a conductive coil wound on the metal piece, and a power cable connected electrically to the conductive coil to provide electric currents to the conductive coil so as to enable the metal piece to generate a magnetic field such that an end of the metal piece has a same magnetic polarity as an end of the magnet to thereby cause the shielding plate to pivot from the closed position to the open position.

In the aforementioned centrifugal fan, the surrounding wall further includes a limiting portion for abutment by the shielding plate so as to limit a pivoting angle of the shielding plate. Thus, when the shielding plate is turned pivotally to the open position, the metal piece can be spaced apart from the magnet by a certain distance such that, when no electric current passes through the conductive coil, the magnet is capable of attracting the metal piece so as to restore the shielding plate to the closed position.

An electronic device of the present invention comprises a device body and a centrifugal fan. The device body defines amounting space. The centrifugal fan is disposed in the mounting space and includes a housing and an impeller. The housing includes a bottom wall and a surrounding wall. The bottom wall includes an air inlet. The surrounding wall extends upwardly from a periphery of the bottom wall, and includes a surrounding wall body defining an opening, a protruding wall body extending outwardly from the surrounding wall body and corresponding to the opening in position, and a shielding plate. The protruding wall body includes a dust-discharging hole. The shielding plate is disposed on the protruding wall body for shielding the dust-discharging hole. The surrounding wall body and the bottom wall cooperatively define an accommodation space that is in fluid communication with the air inlet, and an air outlet in fluid communication with the accommodation space. The protruding wall body, the shielding plate, and the bottom wall cooperatively define a turbulence space in fluid communication with the accommodation space. The shielding plate is movable between a closed position to close the dust-discharging hole, and an open position to open the dust-discharging hole so as to permit fluid communication between the turbulence space and the outside environment. The impeller is disposed in the accommodation space, and is rotatable to result in generation of an air stream.

In the aforementioned electronic device, the device body includes a motherboard disposed in the mounting space and connected electrically to the power cable, and a control button for controlling the motherboard to deliver an electric current to the power cable. The arrangement of the control button allows a user to control pivotal movement of the shielding plate between the closed and open positions.

In the housing for a centrifugal fan of the present invention, through the design of the air blocking wall portion, the connecting wall portion, and the shielding plate of the surrounding wall, a vortex is generated in the turbulence space when air flows therethrough, whereby dust particles entrained in the air stream can accumulate in the turbulence space, thereby achieving a dust-collecting effect. Moreover, by means of the arrangement of the shielding plate which is pivotable from the closed position to the open position, the dust particles in the turbulence space can be discharged from the housing through the dust-discharging hole to thereby achieve a dust-discharging effect.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
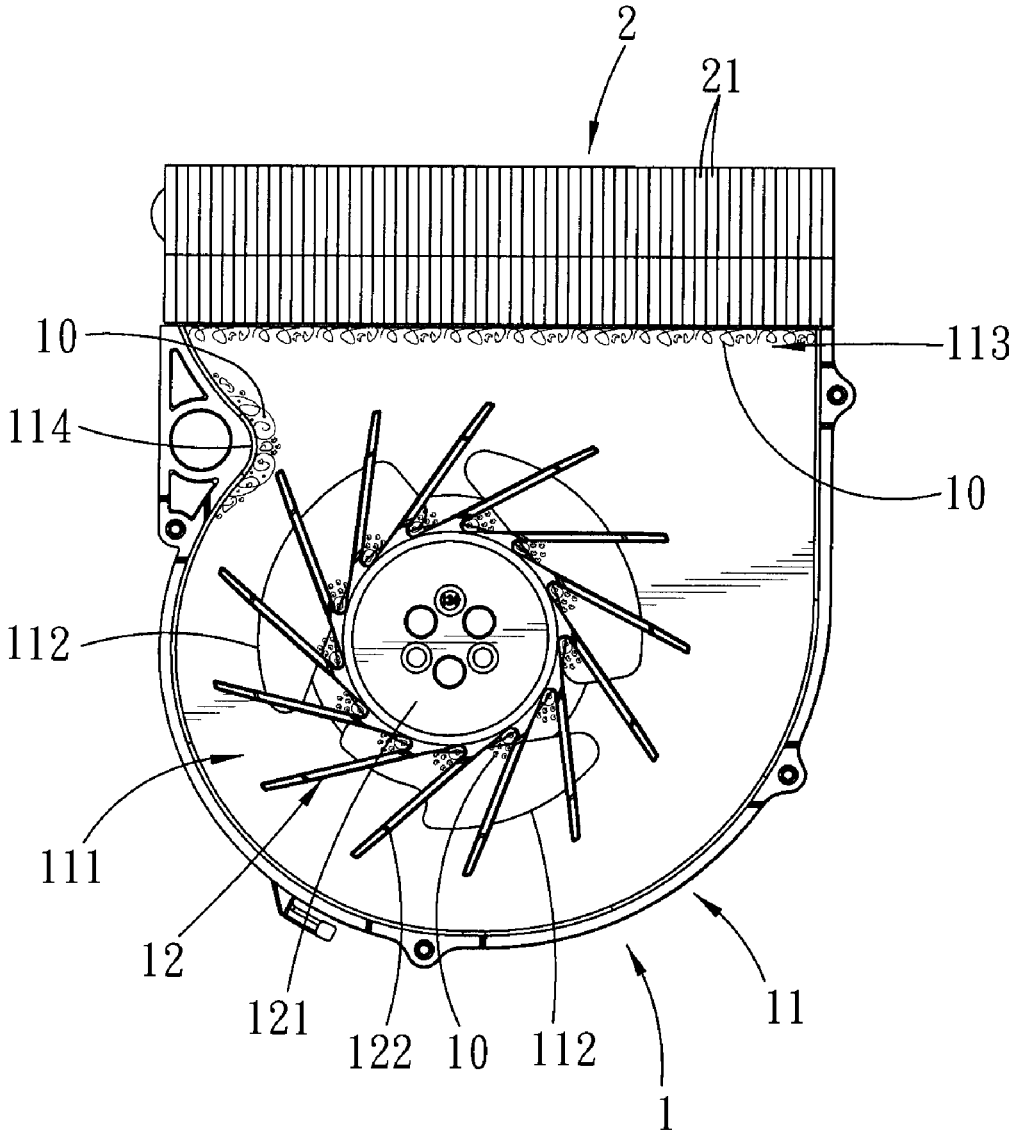
FIG. 1 PRIOR ART
FIG. 1 is a top view of a conventional centrifugal fan and a heat-dissipating fin unit.

Through a description of the preferred embodiments, the technical means employed by the present invention to achieve the intended objects, and the advantageous effects contemplated thereby, can be better understood and appreciated. It is noted that the accompanying drawings are for illustration and reference only, and are not intended to limit the scope of the present invention.

Before the present invention is described in greater detail, it should be noted that like elements are denoted by the same reference numerals throughout the disclosure.

Figure 2:
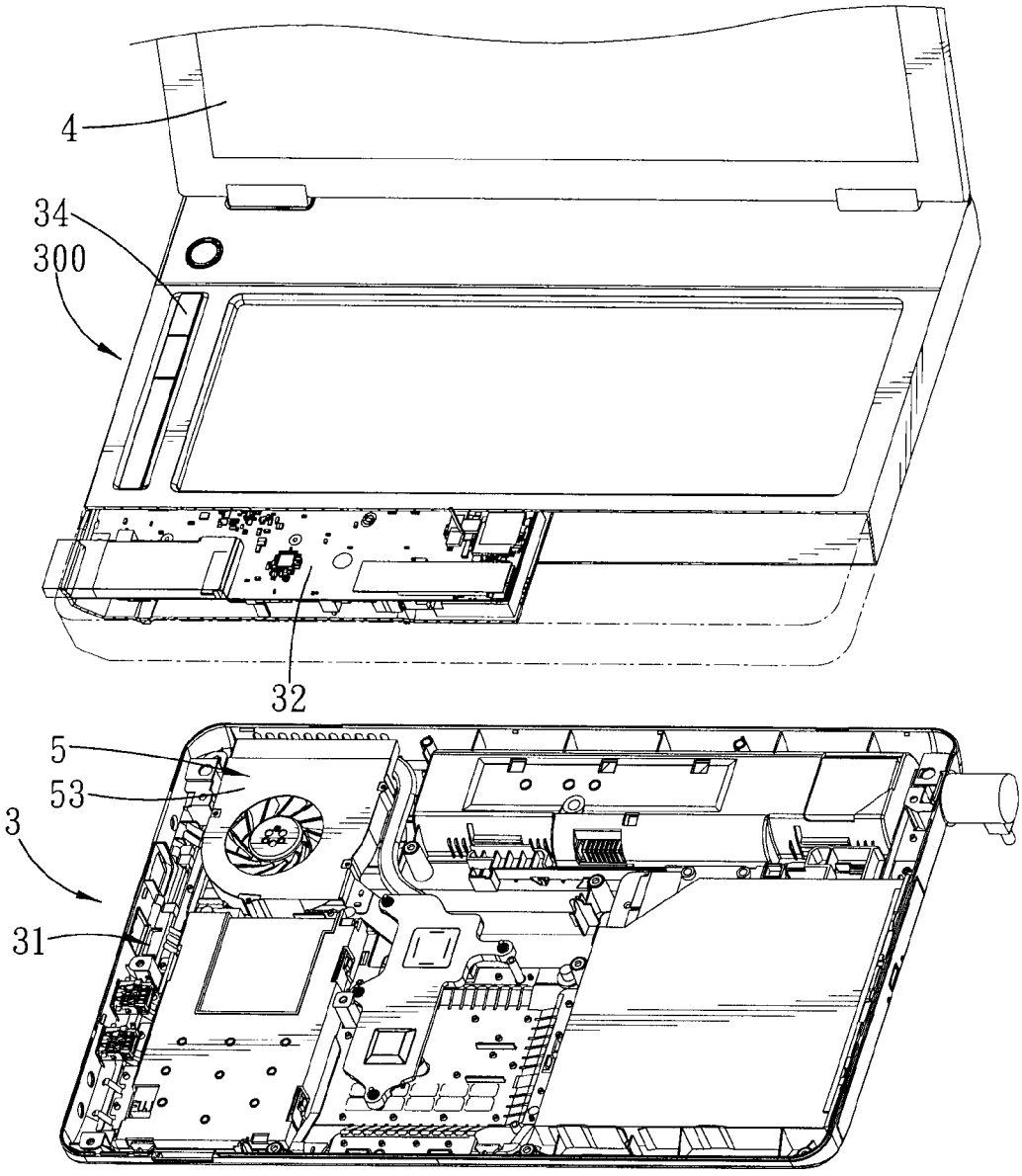
FIG. 2 is an exploded perspective view of the first preferred embodiment of an electronic device having a centrifugal fan according to the present invention.

Referring to FIG. 2, the first preferred embodiment of an electronic device 300 according to the present invention is shown to be a notebook computer. The electronic device 300 includes a device body 3, a display screen 4 connected pivotably to a rear end of the device body 3, and a centrifugal fan 5 disposed in the device body 3. Certainly, the electronic device 300 may be a projector or any other electronic product that requires use of the centrifugal fan 5 for heat dissipation.

Figure 3:
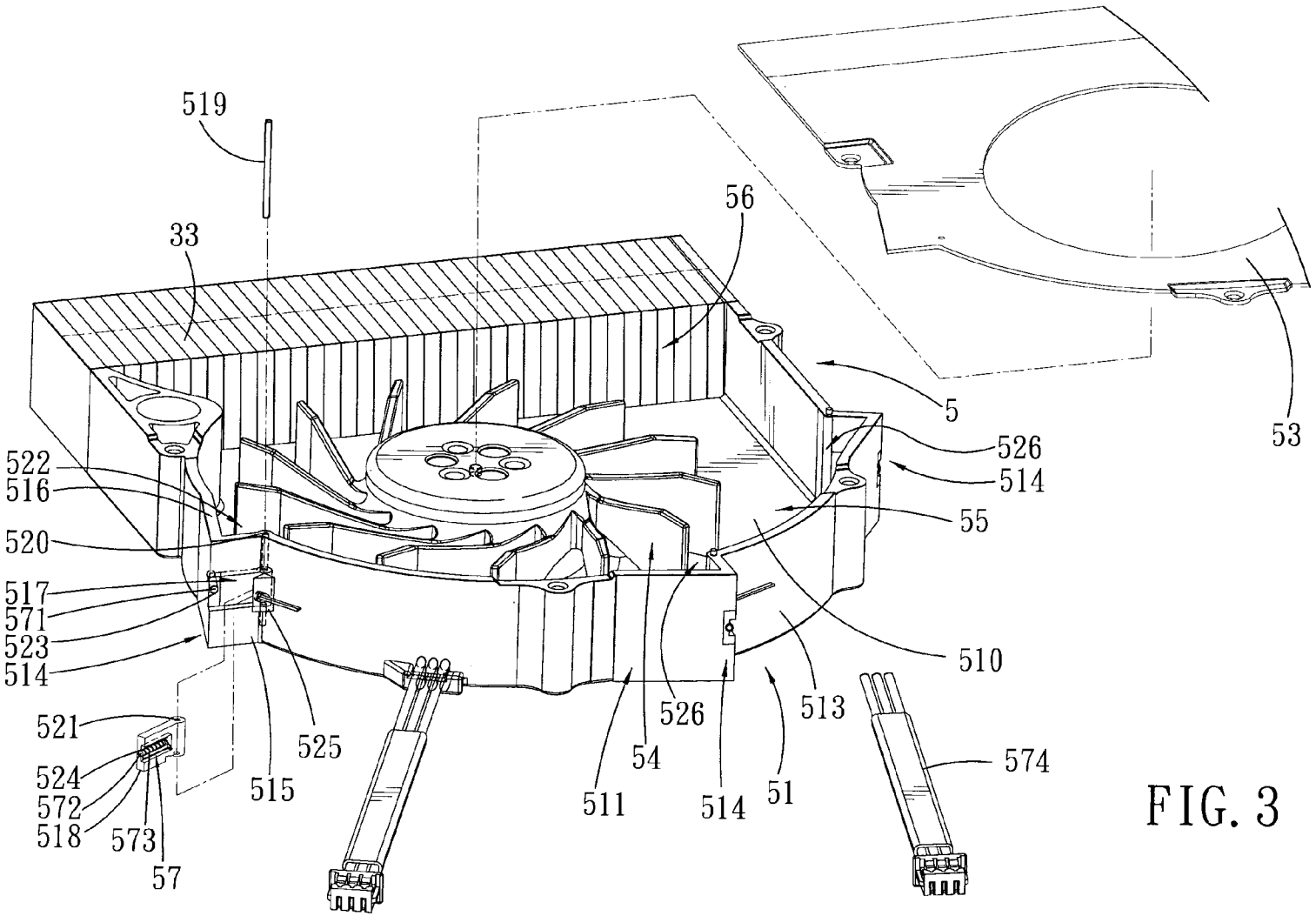
FIG. 3 is an exploded perspective view of the centrifugal fan of the first preferred embodiment of an electronic device according to the present invention, illustrating components of the centrifugal fan and the positional relationship between the centrifugal fan and a heat-dissipating fin unit.
Figure 4:
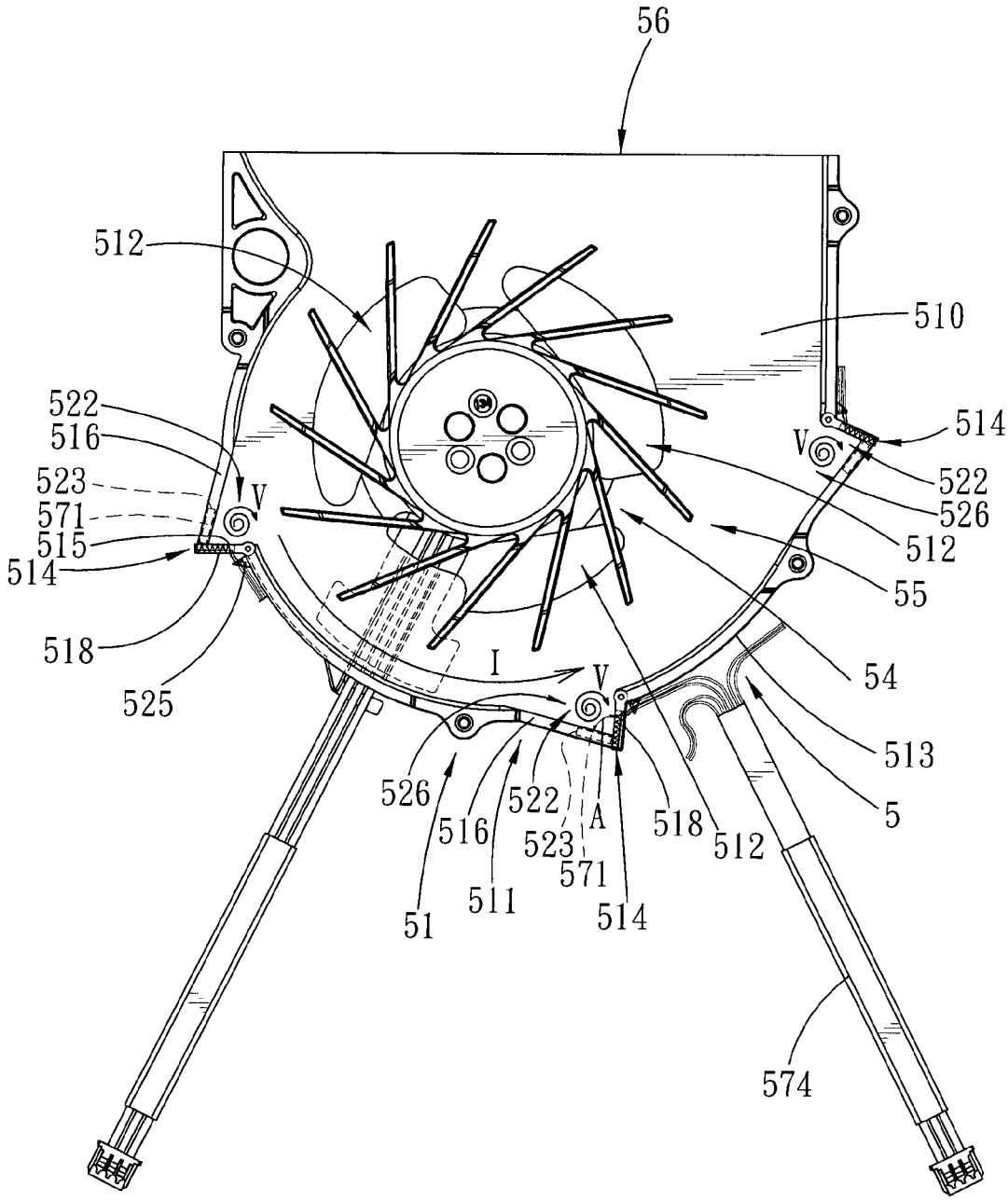
FIG. 4 is a top view of the centrifugal fan of the first preferred embodiment of an electronic device according to the present invention, illustrating an air blocking wall portion and a connecting wall portion of each of protruding wall bodies forming an acute angle, and vortices generated in turbulence spaces by an air stream when shielding plates are in a closed position, a cover of the centrifugal fan being omitted.

As shown in FIGS. 2, 3, and 4, the device body 3 defines a mounting space 31 for mounting the centrifugal fan 5, and includes a motherboard 32 disposed in the mounting space 31 and connected electrically to the centrifugal fan 5. The centrifugal fan 5 includes a housing 51, a cover 53, and an impeller 54. The housing 51 includes a bottom wall 510 and a surrounding wall 511 extending upwardly from a periphery of the bottom wall 510. The cover 53 is mounted on and covers the surrounding wall 511, and cooperates with the housing 51 to define an accommodation space 55 for receiving the impeller 54, and an air outlet 56 in fluid communication with the accommodation space 55. The bottom wall 510 includes a plurality of air inlets 512 in fluid communication with the accommodation space 55. When the impeller 54 rotates, a stream of air can be drawn into the accommodation space 55 through the air inlets 512 and expelled through the air outlet 56 to dissipate the heat around a heat-dissipating fin unit 33 disposed at the air outlet 56.

Figure 5:
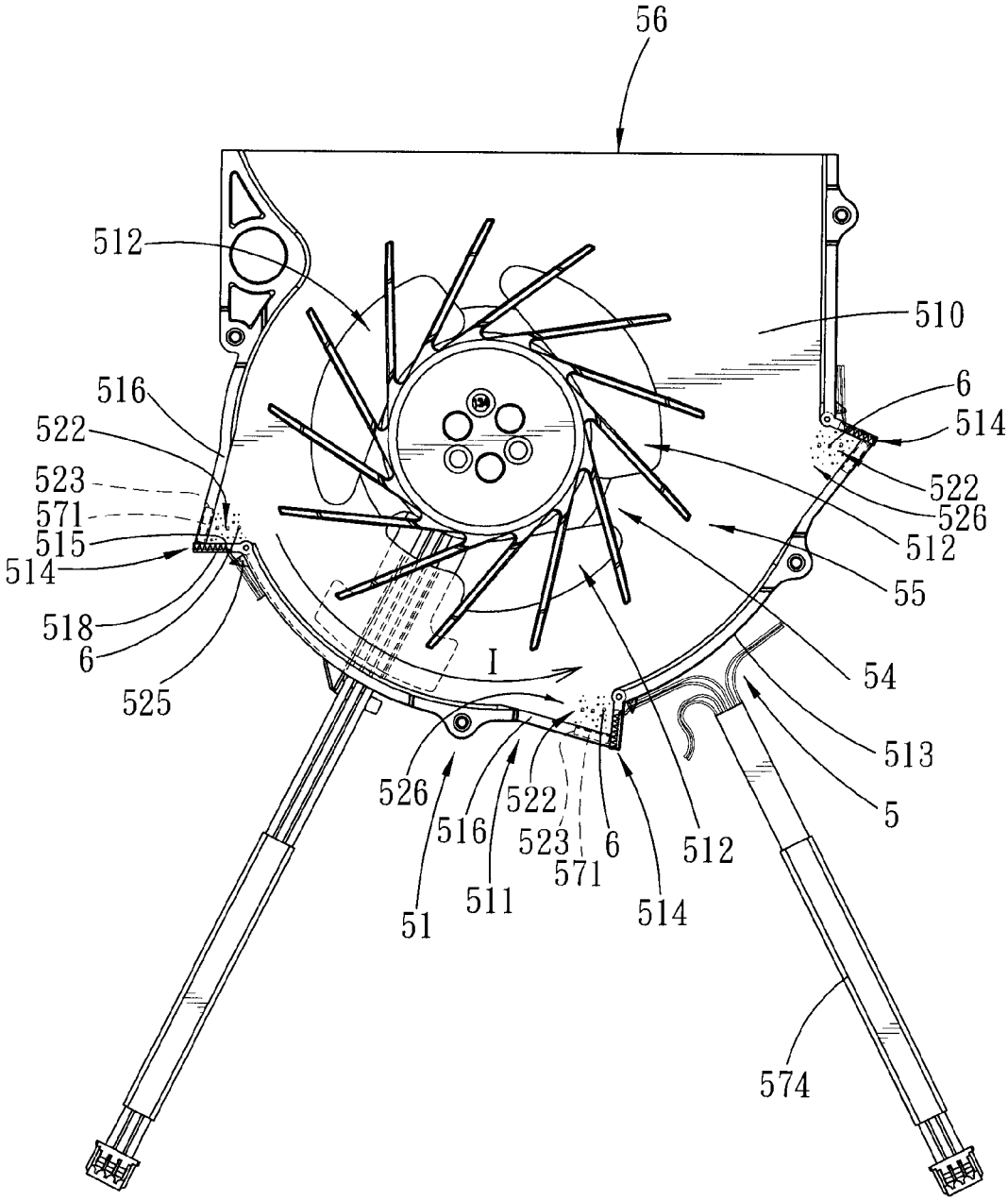
FIG. 5 is a top view similar to FIG. 4, illustrating dust particles collected in the turbulence spaces.

The surrounding wall 511 has a substantially U-shaped structure when viewed from the top, as in FIG. 4, and includes a surrounding wall body 513 that defines a plurality of spaced-apart openings 526, and a plurality of protruding wall bodies 514 that extend outwardly from the surrounding wall body 513 and that correspond respectively to the openings 526 so as to cover the openings 526, respectively. Each of the protruding wall bodies 514 includes an air blocking wall portion 515 extending obliquely outward from the surrounding wall body 513 for blocking the air stream, and a connecting wall portion 516 extending obliquely outward from the surrounding wall body 513. The air blocking wall portion 515 has an outer end connected to an outer end of the connecting wall portion 516, and forms an angle (A) with the connecting wall portion 516. In this embodiment, the angle (A) is an acute angle. Each of the air blocking wall portions 515 is provided with a dust-discharging hole 517. The surrounding wall 511 further includes a plurality of shielding plates 518 for shielding the dust-discharging holes 517, respectively. Each of the shielding plates 518 is connected pivotably to a respective one of the air blocking wall portions 515 through a pivot pin 519 that extends through a through hole 520 in the respective one of the air blocking wall portions 515 and a pivot hole 521 provided in the respective shielding plate 518 such that, when the shielding plate 518 is disposed at a closed position where the shielding plate 518 closes the respective one of the dust-discharging holes 517, the corresponding one of the protruding wall bodies 514, the shielding plate 518, and the bottom wall 510 cooperatively define a turbulence space 522 in fluid communication with the accommodation space 55 for collecting dust particles 6 (see FIG. 5).

In addition, the centrifugal fan 5 further includes an actuating unit 57, which includes a plurality of magnets 571 and a plurality of metal pieces 572. Each of the magnets 571 is disposed in a blind hole 523 provided in a respective one of the connecting wall portions 516. Each of the metal pieces 572 is retained in an engaging groove 524 provided in a respective one of the shielding plates 518. Each of the metal pieces 572 is rod-shaped and can be attracted by a respective one of the magnets 571 so that the respective one of the shielding plates 518 can be positioned at the closed position to close the respective one of the dust-discharging holes 517 (as shown in FIG. 4). It is noted that, in design, the dust-discharging holes 517 may be provided in the connecting wall portions 516 and the shielding plates 518 may be pivoted to the connecting wall portions 516 to shield the dust-discharging holes 517, whereas the magnets 571 may be correspondingly disposed on the air blocking wall portions 515 to exert a magnetic force on the metal pieces 572 on the shielding plates 518. The shielding plates 518 can be likewise positioned at the closed position in this manner. Therefore, the way of positioning the shielding plates 518 should not be limited to the disclosure in this embodiment.

Since each of the air blocking wall portions 515 blocks a flow path (I) of the air stream generated by the impeller 54, when each of the shielding plates 518 is disposed at the closed position, flow of air that is blocked by the air blocking wall portions 515 and the shielding plates 518 will generate a vortex (V) in each of the turbulence spaces 522, so that dust particles 6, such as fine particles, hair, lint, etc., that are carried by the air stream into the accommodation space 55 through the air inlets 512 accumulate in the turbulence spaces 522 little by little. Hence, each of the turbulence spaces 522 can have a dust-collecting effect.

Figure 6:
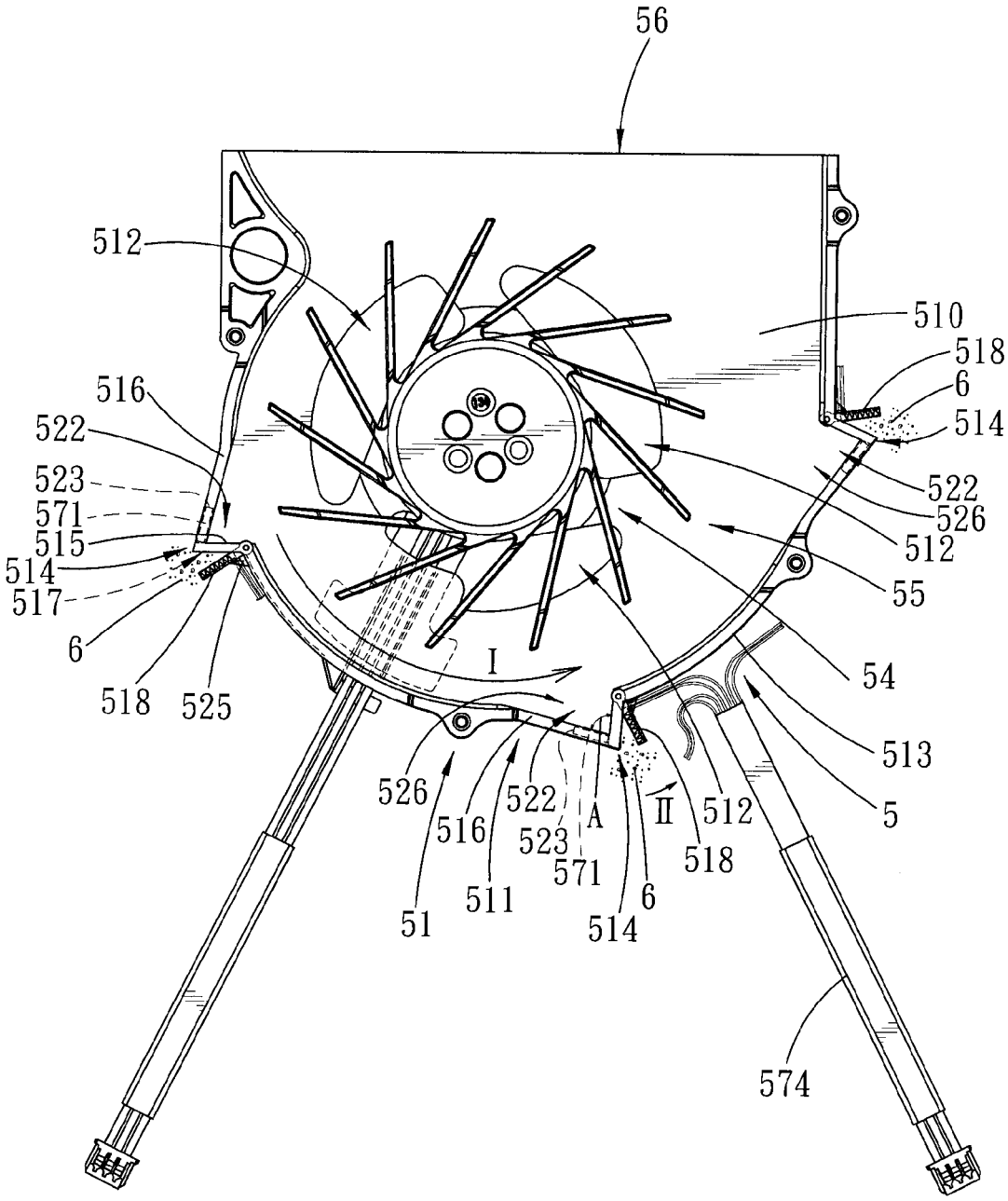
FIG. 6 is a top view similar to FIG. 4, illustrating that dust particles can be discharged from the turbulence spaces through the dust-discharging holes when the shielding plates are at an open position.

The actuating unit 57 further includes a plurality of conductive coils 573 wound respectively on the metal pieces 572, and a power cable 574 connected electrically to the conductive coils 573. The power cable 574 is connected electrically to the motherboard 32 so as to deliver electric currents to the conductive coils 573. The device body 3 of the electronic device 300 further includes a control button 34 for controlling conduction of electric currents from the motherboard 32 to the power cable 574. By depressing the control button 34 to send a control signal to a driving circuit (not shown) of the motherboard 32, the motherboard 32 can deliver electric currents to the conductive coils 573 via the power cable 574 to enable each of the metal pieces 572 to generate a magnetic field such that an end of each of the metal pieces 572 that is adjacent to the corresponding one of the magnets 571 and an end of the corresponding one of the magnets 571 that projects outwardly of the respective blind hole 523 will generate the same magnetic polarity. Since like poles repel, each of the shielding plates 518 will be brought to pivot from the closed position as shown in FIG. 4 to an open position as shown in FIG. 6 by the corresponding metal piece 572. At this time, each of the shielding plates 518 will abut against a limiting portion 525 projecting from an outer wall surface of the surrounding wall body 513. Thus, the pivoting angle of each of the shielding plates 518 can be limited to position the respective shielding plate 518 at the open position. It should be noted that, when mounting the magnets 571 and winding the conductive coils 573, the magnetic polarity of the end of each of the magnets 571 that extends outwardly of the respective blind hole 523 should be ascertained before determining the winding direction of the conductive coils 573 on the metal pieces 572 so that, when an electric current passes through the conductive coils 573 to enable each of the metal pieces 572 to generate a magnetic field, the end of each of the metal pieces 572 adjacent to the respective one of the magnets 571 will have the same magnetic polarity as the end of the respective one of the magnets 571 that extends outwardly of the respective blind hole 523.

As shown in FIGS. 3, 4, 5, and 6, when the electronic device 300 is in use (see FIG. 2), the shielding plates 518 are normally maintained at the closed position, and part of the air stream that is generated as a result of rotation of the impeller 54 will be blocked by the air blocking wall portions 515 and the shielding plates 518 so that a vortex (V) is generated in each of the turbulence spaces 522, thereby resulting in gradual accumulation of the dust particles 6 therein. After a period of time, the user can depress the control button 34 (see FIG. 2) to cause the motherboard 32 (see FIG. 2) to deliver electric currents to each of the conductive coils 573 via the power cable 574 so that each of the metal pieces 572 generates a magnetic field and the end of which that is adjacent to the respective magnet 571 has the same magnetic polarity as the end of the respective magnet 571 that extends outwardly of the respective blind hole 523. Since like poles repel, the shielding plates 518 can be brought by the respective metal pieces 572 to rotate along a direction indicated by arrow (II), and can rotate no further when they respectively abut against the limiting portions 525. The shielding plates 518 are then positioned at the open position. The dust particles 6 collected in each of the turbulence spaces 522 can thus be carried in the air stream generated by the impeller 54 to be discharged directly to the outside of the surrounding wall 511 through the dust-discharging holes 517. Hence, the effect of discharging dust particles 6 can be achieved so that the heat dissipating efficiency of the centrifugal fan 5 will not be adversely affected by the accumulation of the dust particles 6.

By using the limiting portions 525 to respectively restrict the pivoting angles of the shielding plates 518, each of the metal pieces 572 can be spaced apart from the respective magnet 571 by a certain distance such that, when no electric current passes through the respective conductive coil 573, the respective magnet 571 is capable of attracting the metal piece 572 so as to restore the respective shielding plate 518 to the closed position.

Figure 7:
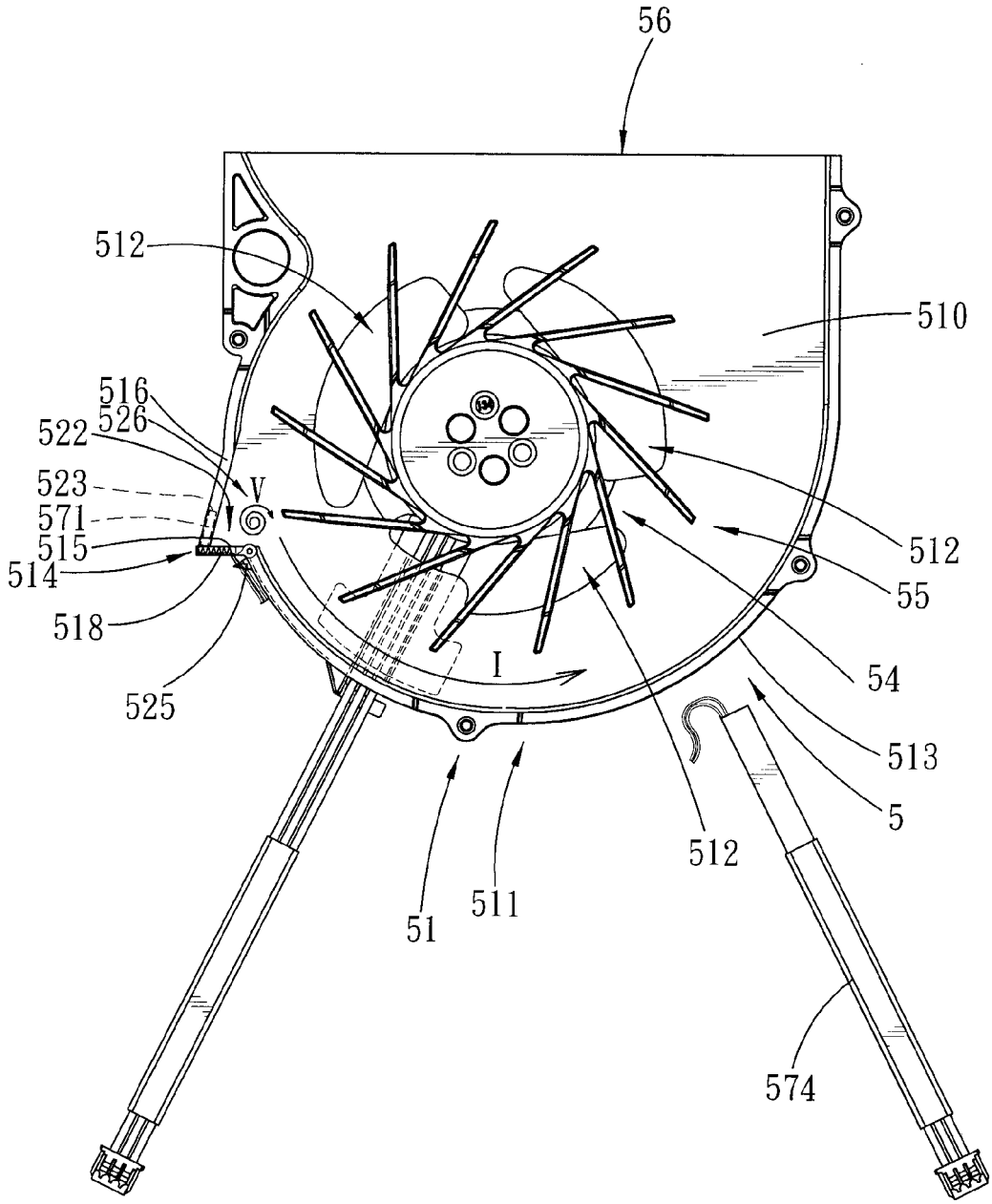
FIG. 7 is a top view of a modified form of the centrifugal fan of the first preferred embodiment of an electronic device according to the present invention without the cover, illustrating that only one protruding wall body is provided.

When it is desired to restore the shielding plates 518 to the closed position, the user may depress the control button 34 once again so as to send a control signal to the driving circuit (not shown) of the motherboard 32 so that the motherboard 32 stops delivering electric currents to each of the conductive coils 573 via the power cable 574. In this state, the metal pieces 572 can bring the respective shielding plates 518 to return to the closed position as shown in FIG. 4 by virtue of the magnetic forces of the magnets 571. Referring to FIG. 7, it is noted that, in design, the surrounding wall 511 may include only one protruding wall body 514 that includes an air blocking wall portion 515 provided with a dust-discharging hole 517, and the surrounding wall 511 may have only one shielding plate 518 for shielding the dust-discharging hole 517. Such a design may achieve the same dust collecting and discharging effects. Therefore, the present invention is not limited to the first preferred embodiment in which the surrounding wall 511 is provided with a plurality of the protruding wall bodies 514.

Figure 8:
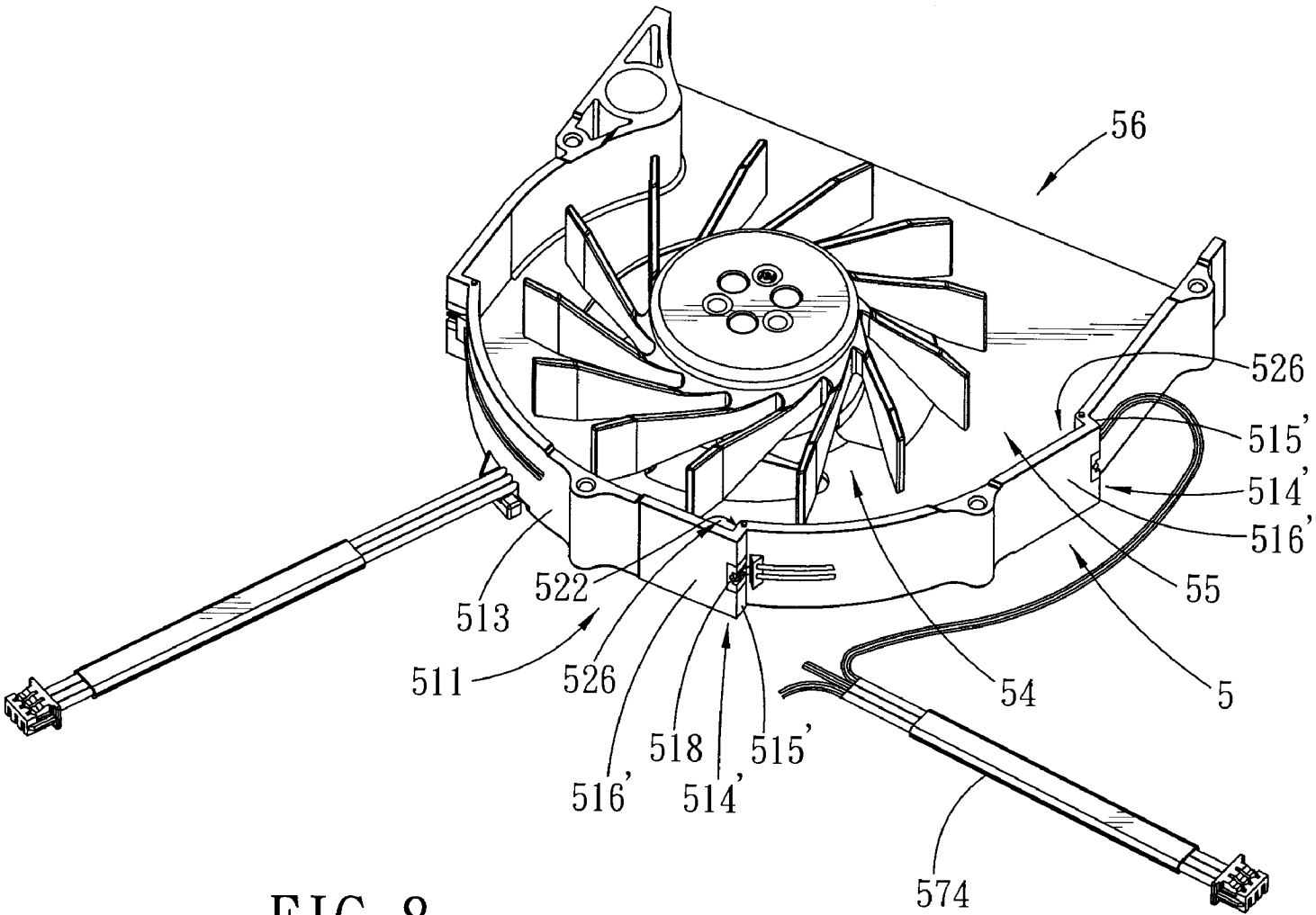
FIG. 8 is an exploded perspective view of a centrifugal fan of the second preferred embodiment of an electronic device according to the present invention, with a cover of the centrifugal fan omitted.
Figure 9:
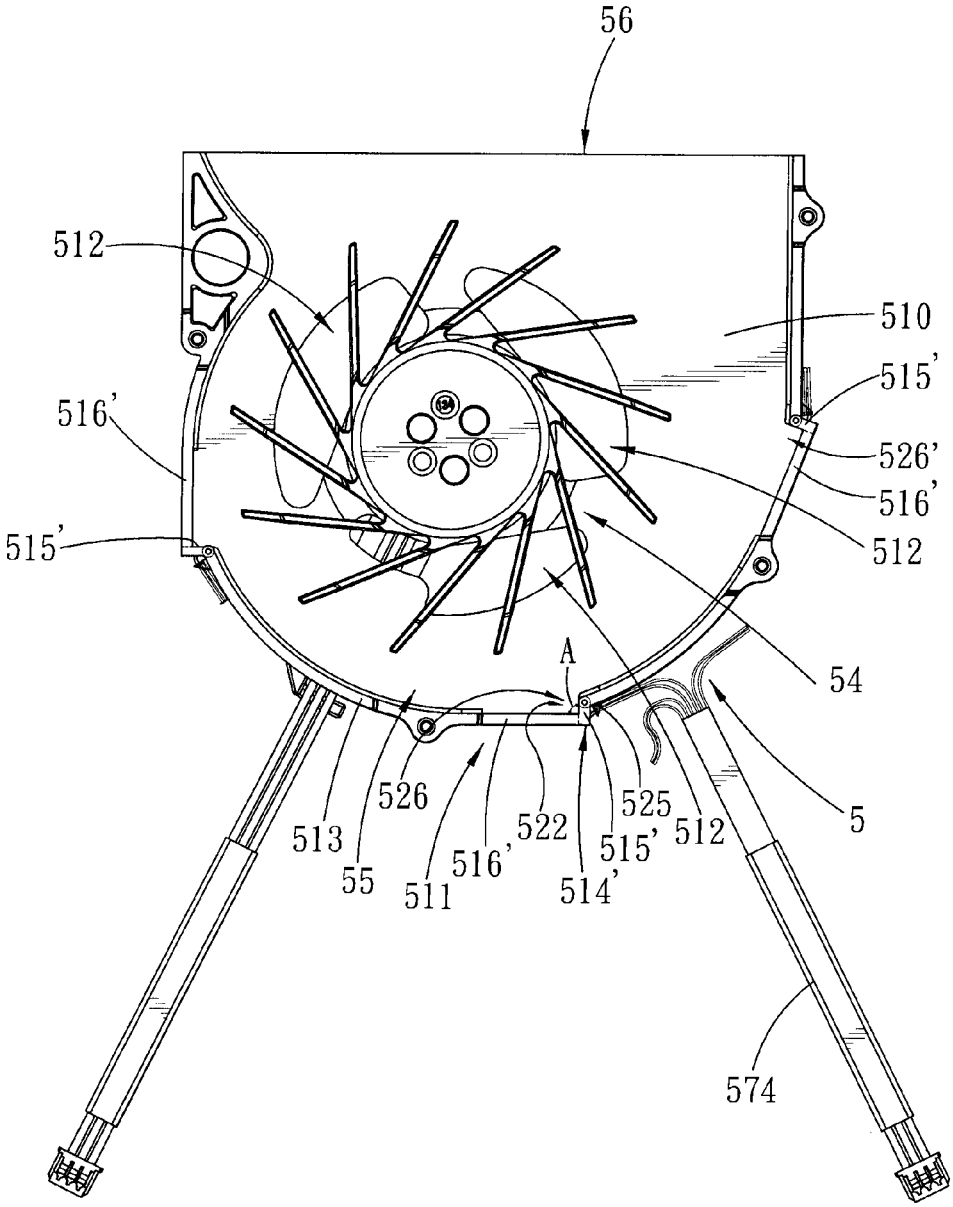
FIG. 9 is a top view of the centrifugal fan of the second preferred embodiment of an electronic device according to the present invention without the cover, illustrating an air blocking wall portion and a connecting wall portion of each of protruding wall bodies forming a right angle.
Figure 10:
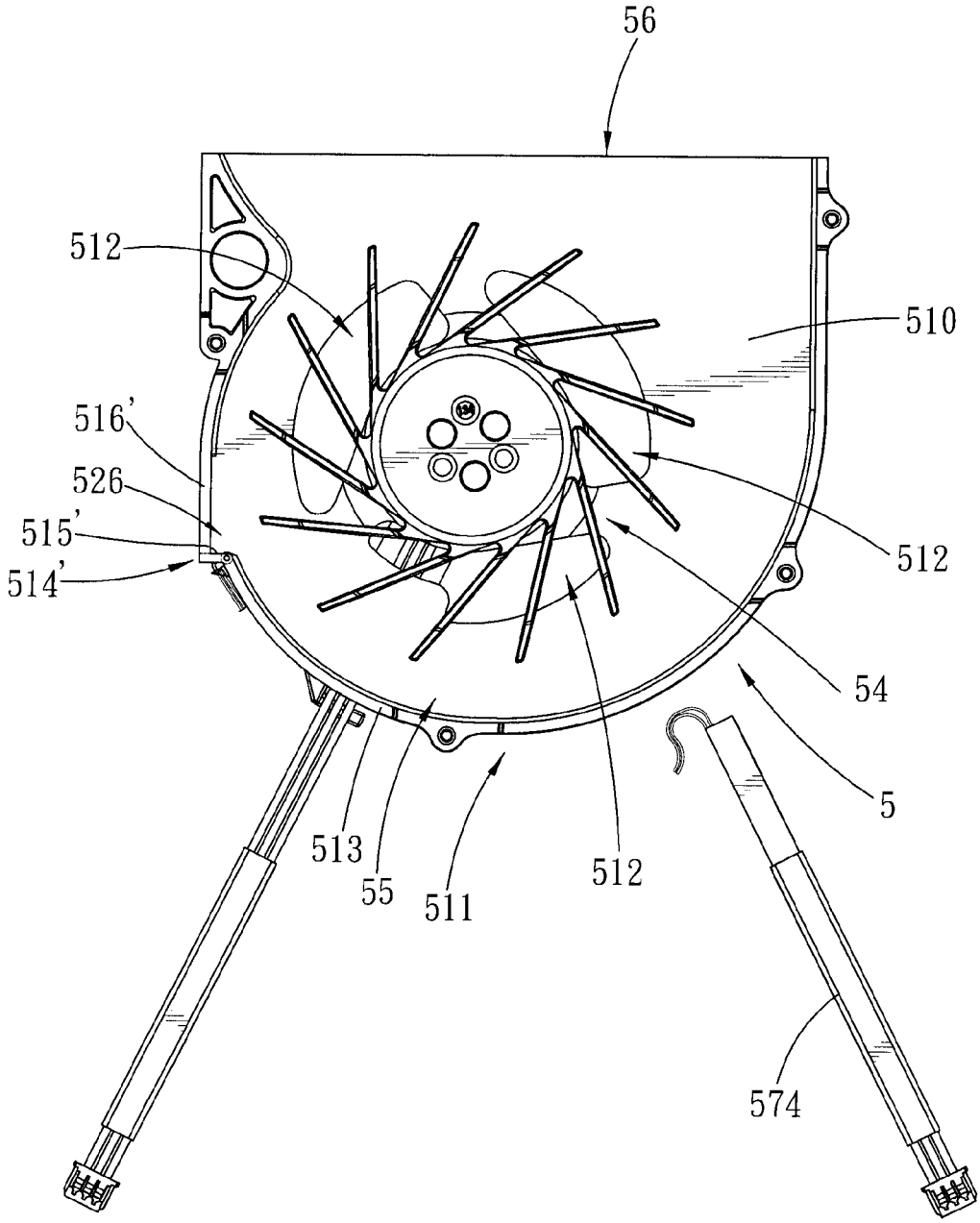
FIG. 10 is a top view of the centrifugal fan of the second preferred embodiment of an electronic device according to the present invention without the cover, illustrating that only one protruding wall body is provided.

Referring to FIGS. 8 and 9, the second preferred embodiment of an electronic device having a centrifugal fan according to the present invention is shown to be similar to the first preferred embodiment in overall structure, and differs therefrom mainly in the size of the angle (A) formed by the air blocking wall portion 515' and the connecting wall portion 516' of each of the protruding wall bodies 514'. In this embodiment, the angle (A) is a right angle. Moreover, the surrounding wall 511 may be configured to include only one protruding wall body 514', as shown in FIG. 10.

In summary, in each of the embodiments of the centrifugal fan 5, through the design of the air blocking wall portions 515, 515', the connecting wall portions 516, 516', and the shielding plates 518 of the surrounding wall 511, a vortex (V) is generated in each of the turbulence spaces 522 when air flows therethrough, whereby the dust particles 6 entrained in the air stream can accumulate in the turbulence spaces 522, thereby achieving a dust-collecting effect. Moreover, by means of the arrangement of the shielding plates 518 which are pivotable from the closed position to the open position, the dust particles 6 in the turbulence spaces 522 can be discharged directly from the housing 51 through the dust-discharging holes 517 to thereby achieve a dust-discharging effect, so that the heat dissipating efficiency of the centrifugal fan 5 will not be adversely affected by the accumulation of the dust particles 6.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A housing for a centrifugal fan, comprising:

a bottom wall including an air inlet; and a surrounding wall extending upwardly from a periphery of said bottom wall, and including a surrounding wall body defining an opening, a protruding wall body extending outwardly from said surrounding wall body and corresponding to said opening in position, and a shielding plate, said protruding wall body including a dust-discharging hole, said shielding plate being disposed on said protruding wall body for shielding said dust-discharging hole, said surrounding wall body and said bottom wall cooperatively defining an accommodation space that is in fluid communication with said air inlet, and an air outlet in fluid communication with said accommodation space, said protruding wall body, said shielding plate, and said bottom wall cooperatively defining a turbulence space in fluid communication with said accommodation space, said shielding plate being movable between a closed position to close said dust-discharging hole, and an open position to open said dust-discharging hole so as to permit fluid communication between said turbulence space and the outside environment.

2. The housing for a centrifugal fan of claim 1, wherein said protruding wall body includes an air blocking wall portion extending outwardly from said surrounding wall body for blocking airflow, and a connecting wall portion extending outwardly from said surrounding wall body, said air blocking wall portion having an outer end connected to an outer end of said connecting wall portion such that said air blocking wall portion and said connecting wall portion form an angle therebetween.

3. The housing for a centrifugal fan of claim 2, wherein the angle is one of a right angle and an acute angle.

4. The housing for a centrifugal fan of claim 2, wherein said dust-discharging hole is provided in said air blocking wall portion, said shielding plate being connected pivotably to said air blocking wall portion and being pivotable between the closed and open positions.

5. The housing for a centrifugal fan of claim 3, wherein said dust-discharging hole is provided in said air blocking wall portion, said shielding plate being connected pivotably to said air blocking wall portion and being pivotable between the closed and open positions.

6. A centrifugal fan comprising:

a housing including a bottom wall and a surrounding wall, said bottom wall including an air inlet, said surrounding wall extending upwardly from a periphery of said bottom wall, and including a surrounding wall body defining an opening, a protruding wall body extending outwardly from said surrounding wall body and corresponding to said opening in position, and a shielding plate, said protruding wall body including a dust-discharging hole, said shielding plate being disposed on said protruding wall body for shielding said dust-discharging hole, said surrounding wall body and said bottom wall cooperatively defining an accommodation space that is in fluid communication with said air inlet, and an air outlet in fluid communication with said accommodation space, said protruding wall body, said shielding plate, and said bottom wall cooperatively defining a turbulence space in fluid communication with said accommodation space, said shielding plate being movable between a closed position to close said dust-discharging hole, and an open position to open said dust-discharging hole so as to permit fluid communication between said turbulence space and the outside environment; and an impeller disposed in said accommodation space, said impeller being rotatable to result in generation of an air stream.

7. The centrifugal fan of claim 6, wherein said protruding wall body includes an air blocking wall portion extending outwardly from said surrounding wall body for blocking airflow, and a connecting wall portion extending outwardly from said surrounding wall body, said air blocking wall portion having an outer end connected to an outer end of said connecting wall portion such that said air blocking wall portion and said connecting wall portion form an angle therebetween.

8. The centrifugal fan of claim 7, wherein the angle is one of a right angle and an acute angle.

9. The centrifugal fan of claim 7, wherein said air blocking wall portion blocks a flow path of the air stream generated by said impeller.

10. The centrifugal fan of claim 8, wherein said air blocking wall portion blocks a flow path of the air stream generated by said impeller.

11. The centrifugal fan of claim 10, wherein said dust-discharging hole is provided in said air blocking wall portion, said shielding plate being connected pivotably to said air blocking wall portion and being pivotable between the closed and open positions.

12. The centrifugal fan of claim 11, further comprising an actuating unit that includes a magnet disposed on said connecting wall portion, and a metal piece disposed on said shielding plate, said metal piece being attracted by said magnet so as to position said shielding plate at the closed position.

13. The centrifugal fan of claim 12, wherein said metal piece is rod-shaped, said actuating unit further including a conductive coil wound on said metal piece, and a power cable connected electrically to said conductive coil to provide electric currents to said conductive coil so as to enable said metal piece to generate a magnetic field such that an end of said metal piece has a same magnetic polarity as an end of said magnet to thereby cause said shielding plate to pivot from the closed position to the open position.

14. The centrifugal fan of claim 13, wherein said surrounding wall further includes a limiting portion for abutment by said shielding plate so as to limit a pivoting angle of said shielding plate.

15. An electronic device, comprising:

a device body defining a mounting space; and a centrifugal fan disposed in said mounting space and including a housing including a bottom wall and a surrounding wall, said bottom wall including an air inlet, said surrounding wall extending upwardly from a periphery of said bottom wall, and including a surrounding wall body defining an opening, a protruding wall body extending outwardly from said surrounding wall body and corresponding to said opening in position, and a shielding plate, said protruding wall body including a dust-discharging hole, said shielding plate being disposed on said protruding wall body for shielding said dust-discharging hole, said surrounding wall body and said bottom wall cooperatively defining an accommodation space that is in fluid communication with said air inlet, and an air outlet in fluid communication with said accommodation space, said protruding wall body, said shielding plate, and said bottom wall cooperatively defining a turbulence space in fluid communication with said accommodation space, said shielding plate being movable between a closed position to close said dust-discharging hole, and an open position to open said dust-discharging hole so as to permit fluid communication between said turbulence space and the outside environment; and an impeller disposed in said accommodation space, said impeller being rotatable to result in generation of an air stream.

16. The electronic device of claim 15, wherein said protruding wall body includes an air blocking wall portion extending outwardly from said surrounding wall body for blocking airflow, and a connecting wall portion extending outwardly from said surrounding wall body, said air blocking wall portion having an outer end connected to an outer end of said connecting wall portion such that said air blocking wall portion and said connecting wall portion form an angle therebetween, the angle being one of a right angle and an acute angle.

17. The electronic device of claim 16, wherein said air blocking wall portion blocks a flow path of the air stream generated by said impeller.

18. The electronic device of claim 17, wherein said dust-discharging hole is provided in said air blocking wall portion, said shielding plate being connected pivotably to said air blocking wall portion, said centrifugal fan further including an actuating unit that includes a magnet disposed on said connecting wall portion, and a metal piece disposed on said shielding plate, said metal piece being attracted by said magnet so as to position said shielding plate at the closed position.

19. The electronic device of claim 18, wherein said metal piece is rod-shaped, said actuating unit further including a conductive coil wound on said metal piece, and a power cable connected electrically to said conductive coil to provide electric currents to said conductive coil so as to enable said metal piece to generate a magnetic field such that an end of said metal piece has a same magnetic polarity as an end of said magnet to thereby cause said shielding plate to pivot from the closed position to the open position.

20. The electronic device of claim 19, wherein said device body includes a motherboard disposed in said mounting space and connected electrically to said power cable, and a control button for controlling said motherboard to deliver electric current to said power cable.

* * * * *